US006184769B1

(12) United States Patent
Nakamura et al.

(10) Patent No.: US 6,184,769 B1
(45) Date of Patent: Feb. 6, 2001

(54) MONOLITHIC VARISTOR

(75) Inventors: Kazutaka Nakamura; Kazuhiro Kaneko, both of Shiga-ken; Tsuyoshi Kawada, Omihachiman; Kenjiro Hadano, Yokaichi, all of (JP)

(73) Assignee: Murata Manufacturing Co., Ltd. (JP)

( * ) Notice: Under 35 U.S.C. 154(b), the term of this patent shall be extended for 0 days.

(21) Appl. No.: 09/276,149

(22) Filed: Mar. 26, 1999

(30) Foreign Application Priority Data

Mar. 26, 1998 (JP) ..... 10-078894

(51) Int. Cl.[7] ..... H01C 7/10
(52) U.S. Cl. ..... 338/21; 338/20; 338/328
(58) Field of Search ..... 338/13, 20, 21, 338/328; 361/117, 121, 127

(56) References Cited

U.S. PATENT DOCUMENTS

| | | | | |
|---|---|---|---|---|
| 4,290,041 | * | 9/1981 | Utsumi et al. | 338/21 |
| 4,675,644 | * | 6/1987 | Ott et al. | 338/21 |
| 5,075,665 | * | 12/1991 | Taira et al. | 338/21 |
| 5,119,062 | * | 6/1992 | Nakamura et al. | 338/20 |
| 5,155,464 | * | 10/1992 | Cowman et al. | 338/21 |

FOREIGN PATENT DOCUMENTS

| | | | | |
|---|---|---|---|---|
| 166907 | * | 3/1989 | (JP) | 338/21 |
| 3-183829 | * | 1/1993 | (JP) | 338/21 |
| 5-21211 | * | 1/1993 | (JP) | 338/21 |

* cited by examiner

*Primary Examiner*—Karl D. Easthom
(74) *Attorney, Agent, or Firm*—Ostrolenk, Faber, Gerb & Soffen, LLP

(57) ABSTRACT

A monolithic varistor includes a sintered layered body and a pair of external electrodes disposed on opposite ends of the layered body. The layered body is composed of a plurality of varistor sheets and a plurality of valistor electrodes, which are layered on one another and integrally fired. T is defined as the distance between the varistor electrodes, and Ty is defined as the distance between an outermost varistor electrode and the upper surface of the sintered layered body. Further, Tx is defined as the distance between the external electrodes and the corresponding edges of the varistor electrodes. The varistor is designed in order to satisfy one of the following three conditions:

Condition (A) $1.5 \leqq (Tx/T) \leqq 3.0$

Condition (B) $(Ty/T) \geqq 1.0$

Condition (C) $1.5 \leqq (Tx/T) \leqq 3.0$ and $(Ty/T) \geqq 1.0$

3 Claims, 5 Drawing Sheets

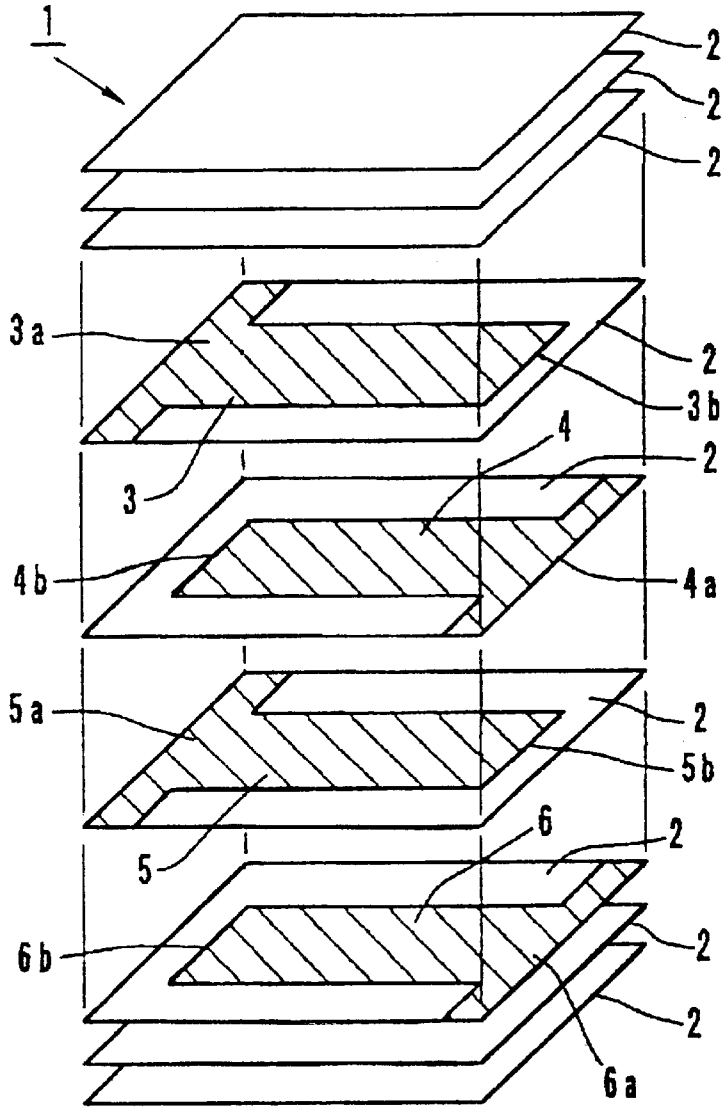
FIG. 1
FIG. 2
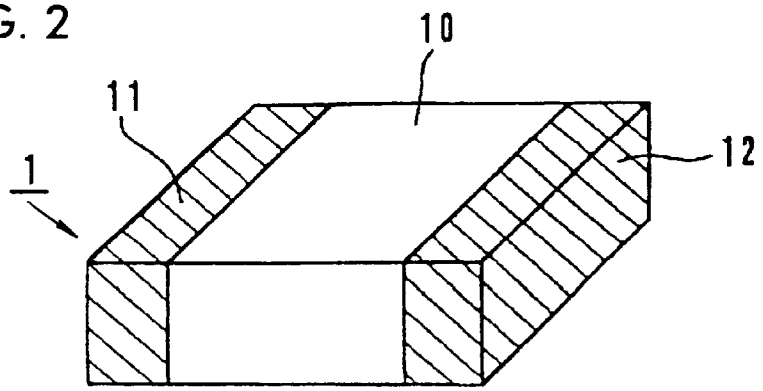

MONOLITHIC VARISTOR

BACKGROUND OF THE INVENTION

1. Field of the Invention

The present invention relates to a monolithic varistor, and particularly to a monolithic varistor used for protecting electronic equipment from surge (abnormally high voltage).

2. Description of the Related Art

In order to cope with recent miniaturization of electronic equipment and increased signal-processing speed, electronic parts have been surface-mounted more frequently, and their operation frequencies have been increased. A non-linear resistor serving as a noise absorber is not an exception to this trend; a surface-mount-type varistor formed mainly of zinc oxide (ZnO) or strontium titanate ($SrTiO_3$) has been put into practical use.

As a measure for reducing the size, especially the height, of a varistor, there has been proposed a method in which a plurality of varistor material layers and a plurality of internal electrodes are layered in order to form a monolithic varistor. However, in the case of a varistor that must have a varistor voltage of 100 V or greater, the distance between adjacent internal electrodes (hereinafter referred to as an "inter-internal electrode distance") in the direction perpendicular to the layered varistor material layers and internal electrodes must be increased, so that employment of a layered structure is difficult.

However, thanks to recent improvements on varistor materials, the varistor voltage per unit inter-internal electrode distance has been increased, making employment of a layered structure possible in terms of varistor voltage. However, there has arisen a new problem that an increased varistor voltage causes a drastic decrease in maximum surge current that can be withstood by the varistor. Thus, the size of layered varistors cannot be decreased, and only varistors having a size similar to that of a single-layer-type varistor can be produced.

SUMMARY OF THE INVENTION

In view of the foregoing, an object of the present invention is to provide a compact monolithic varistor having an increased maximum surge current.

To achieve the above object, according to a first aspect of the present invention, there is provided a monolithic varistor comprising a sintered layered body and a pair of external electrodes disposed on opposite ends of the layered body. The sintered layered body comprises a plurality of varistor material layers and a plurality of internal electrodes, which are layered on one another. When T is defined as an inter-inner electrode distance in the direction perpendicular to the layered varistor material layers and the internal electrodes and Tx is defined as the distance between the external electrode provided on either end of the sintered layered body and the corresponding edges of the internal electrodes in a direction parallel to the layered layers, Tx is 1.5 to 3.0 times T.

Since the distance Tx between each external electrode and the corresponding edges of the internal electrodes is set to 1.5 to 3.0 times the inter-inner electrode distance, a high maximum surge current can obtained while a high varistor voltage is maintained, so that the size of a monolithic varistor can be decreased as compared with conventional single-layer type varistors.

According to a second aspect of the present invention, when Ty is defined as the distance between an outermost inner electrode and the surface of the sintered layered body, Ty is equal to or greater than T.

In this case, since the distance Ty between an outermost inner electrode and the surface of the sintered layered body is made equal or greater than the inter-internal electrode distance T, the maximum surge current is maintained constant, so that stable monolithic varistors having a reduced variation in maximum surge current can be obtained.

According to a third aspect of the present invention, Tx is 1.5 to 3.0 times T, and Ty is equal to or greater than T.

In this case, monolithic varistors having a stable and increased maximum surge current can be obtained.

In the varistors of the present invention preferably have a varistor voltage of 100 V or greater. In this case, the above-described advantageous effects become more remarkable.

BRIEF DESCRIPTION OF THE DRAWINGS

FIG. 1 is an exploded perspective view of a monolithic varistor according to a first embodiment of the present invention;

FIG. 2 is a perspective view showing the appearance of the monolithic varistor shown in FIG. 1;

DESCRIPTION OF THE PREFERRED EMBODIMENTS

Figure 3:
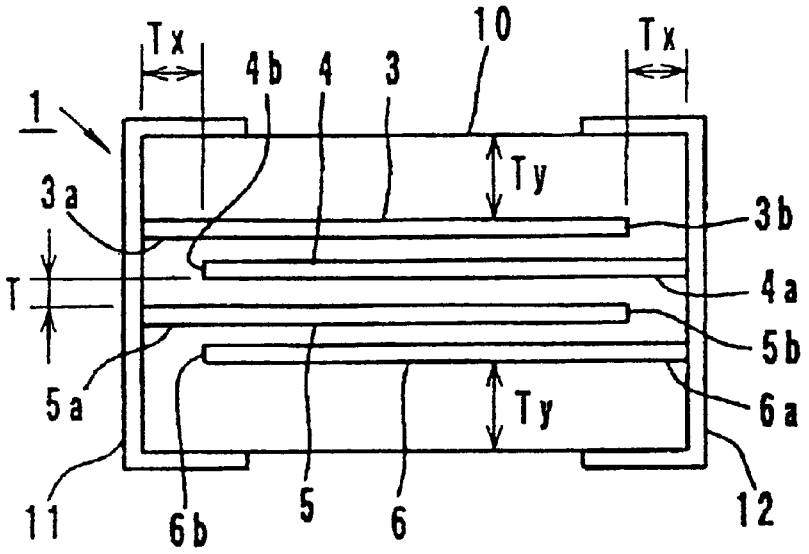
FIG. 3 is a schematic vertical cross section of the monolithic varistor shown in FIG. 2.
Figure 4:
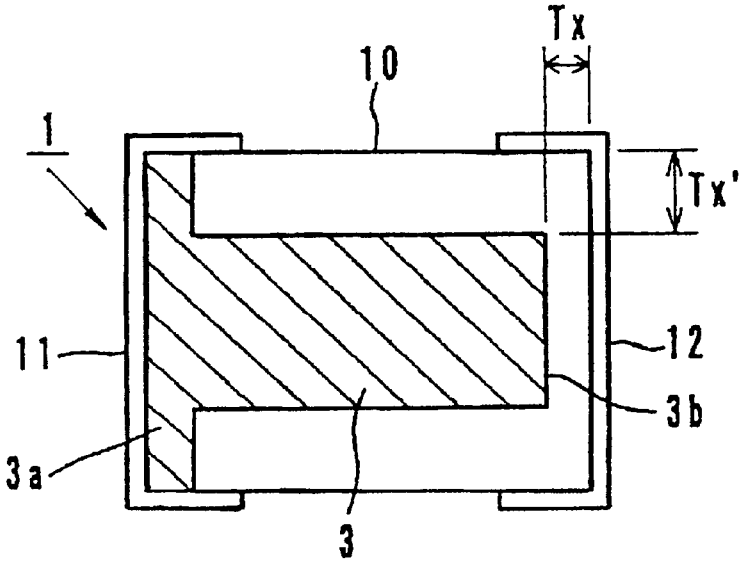
FIG. 4 is a schematic horizontal cross section of the monolithic varistor shown in FIG. 2.

Embodiments of the present invention will be described with reference to the accompanying drawings. The embodiments will be described with reference to an exemplary varistor having a varistor voltage of 100 V or greater, because when the varistor voltage is less than 100 V, the advantageous effects of the present invention do not appear remarkably.

Embodiment 1, FIGS. 1 to 7

As shown in FIG. 1, a monolithic varistor 1 is composed of varistor sheets 2 on which varistor electrodes 3–6 are respectively provided and protective varistor sheets 2 having no conductor thereon.

Each of the varistor sheets 2 is formed of a semiconductor material containing zinc oxide (ZnO), strontium titanate ($SrTiO_3$), or the like as a main component.

In the first embodiment, the varistor sheets 2 are manufactured in the following manner. To ZnO (100 mol %) are added $Bi_2O_3$, (1.0 mol %), MnO (0.5 mol %), CoO (0.5 mol %), $SiO_2$ (1.0 mol %), $B_2O_3$ (0.1 mol %), $Sb_2O_3$ (0.5 mol %), and $Al_2O_3$ (100 ppm). The resulting mixture is mixed and pulverized for 20 hours through use of a ball mill, obtaining slurry. The thus-obtained slurry is dewatered and dried, followed by granulation through use of a #60 mesh sieve. The powdery product is prefired at 750° C. for 2 hours. The thus-obtained prefired product is subjected to coarse pulverization and then mixed and pulverized again through use of a ball mill. The thus-obtained slurry is dewatered and dried to obtain powder. A solvent, a binder, and a dispersing agent are added the thus-obtained powder—which contains ZnO as a main component—to obtain a varistor green sheet having a thickness of 50 $\mu$m.

Varistor electrodes 3 and 5 are formed on the surfaces of a pair of varistor sheets 2, and their lead portions 3*a* and 5*a* are exposed at the left sides of the varistor sheets 2. Varistor electrodes 4 and 6 are formed on the surfaces of another pair of varistor sheets 2, and their lead portions 4*a* and 6*a* are exposed at the right sides of the varistor sheets 2. The varistors 3 to 6 face one another with the varistor sheets 2 interposed therebetween. The varistor electrodes 3–6 are made of Ag, Cu, Ni, Cr, Pd, Pt, or an alloy thereof and are formed through spattering, vacuum deposition, printing, or the like. In the first embodiment, the varistor electrodes 3–6 are formed through use of Pt paste and in accordance with a screen printing method.

The respective sheets 2 are layered, and the resin component thereof is decomposed and evaporated. Subsequently, the sheets 2 are fired at 900° C. for 3 hours to obtain the sintered layered body 10 as shown in FIG. 2. External electrodes 11 and 12 are provided on right and left ends of the layered body 10. The external electrodes 11 and 12 are formed from Ag, Ni, Ag—Pd, or the like through a spattering method, an application/baking method, or a like method. The lead portions 3*a* and 5*a* of the varistor electrodes 3 and 5 are electrically connected to the external electrode 11, and the lead portions 4*a* and 6*a* of the varistor electrodes 4 and 6 are electrically connected to the external electrode 12.

As shown in FIG. 3, in the monolithic varistor 1 having the above-described structure, T is defined as the distance between the varistor electrodes 3–6 in the direction perpendicular to the layered varistor sheets 2; and Ty is defined as the distance between an outermost varistor electrode 3 and the upper surface of the sintered layered body 10 and the distance between an outermost varistor electrode 6 and the lower surface of the sintered layered body 10. Further, Tx is defined as the distance between the external electrode 12 provided on the right end of the sintered layered body 10 and the corresponding edges 3*b* and 5*b* of the varistor electrodes 3 and 5 in a direction perpendicular to the lamination direction; and also as the distance between the external electrode 11 provided on the left end of the sintered layered body 10 and the corresponding edges 4*b* and 6*b* of the varistor electrodes 4 and 6 in the direction perpendicular to the lamination direction. The varistor 1 is designed in order to satisfy one of the following three conditions:

Condition (A) $1.5 \leqq (Tx/T) \leqq 3.0$

Condition (B) $(Ty/T) \geqq 1.0$

Condition (C) $1.5 \leqq (Tx/T) \leqq 3.0$ and $(Ty/T) \geqq 1.0$

When the distance Tx is greater than the distance Tx' (see FIG. 4) between the circumferential portion of the external electrode 12 and the corresponding edges 3*b* and 5*b* of the varistor electrodes 3 and 5, the distance Tx' is used as the distance Tx. Also, when the distance Tx is greater than the distance Tx' between the circumferential portion of the external electrode 11 and the corresponding edges 4*b* and 6*b* of the varistor electrodes 4 and 6, the distance Tx' is used as the distance Tx.

Figure 5:
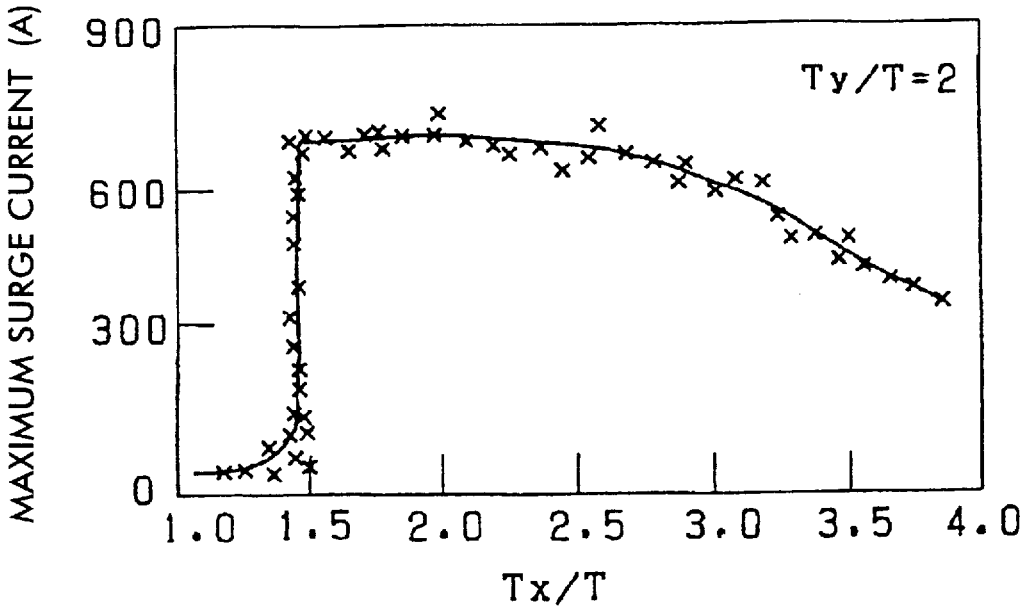
FIG. 5 is a graph showing the relationship between Tx/T and maximum surge current.

The case in which condition (A) is satisfied will be first described. Condition (A) means that the distance Tx between the edges 3*b* and 5*b* of the varistor electrodes 3 and 5 and the external electrode 12 and between the edges 4*b* and 6*b* of the varistor electrodes 4 and 6 and the external electrode 11 is 1.5 to 3.0 times the inter-electrode distance T of the varistor electrodes 3–6. FIG. 5 is a graph showing the result of an experiment for determining the relationship between Tx/T and maximum surge current of the varistor 1. In this experiment, varistors having different values of Tx/T were produced, while the distance T was maintained constant and the distance Tx was varied; and the respective maximum surge currents of the thus-produced varistors 1 were measured.

As is apparent from the graph, when the value of Tx/T is in the range of 1.5 to 3.0, a high maximum surge current can be obtained. When the value of Tx/T becomes less than 1.5, the maximum surge current decreases drastically and becomes less than 10% the highest maximum surge current of the varistor 1. Conceivably, this drastic decrease occurs due to the following reasons.

(1) During the firing process for production of the varistor 1, only the surface portion of the sintered layered body is exposed to a gas atmosphere or the like, so that the characteristics of the surface portion of the sintered layered body 10 differ slightly from those of the inner portion of the sintered layered body 10 where the varistor electrodes 3–6 are disposed.

(2) Internal defects or the like are generated at the junction portions (interface portions) between the respective varistor sheets 2.

As the value of Tx/T increases (i.e., as the distance Tx increases), the maximum surge current decreases regardless of the area of the varistor electrodes 3–6. This phenomenon conceivably occurs because, due to the heat generation of the resistor component of the varistor electrodes 3–6 and heat radiation of the external electrodes 11 and 12, the amount of heat accumulated inside the varistor 1 increases with the distance Tx, so that thermal stress is generated. When the value of Tx/T exceeds 3.0, the maximum surge current decreases considerably, so that problems occur upon use.

Figure 6:
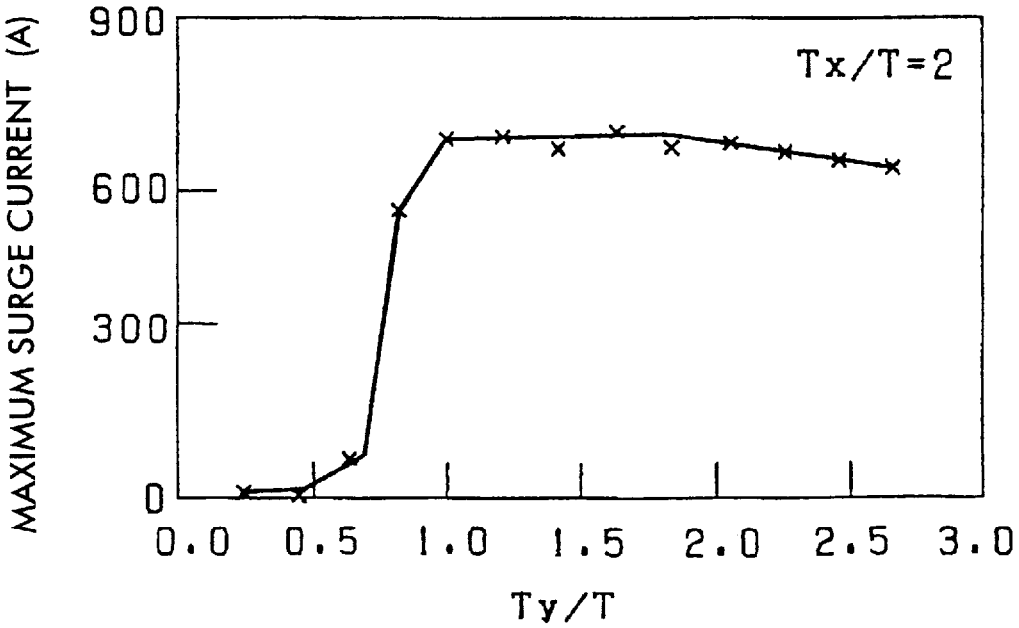
FIG. 6 is a graph showing the relationship between Ty/T and maximum surge current.

Next, the case in which the condition (B) is satisfied will be described. Condition (B) means that the distance Ty between the outermost varistor electrodes 3 and 6 and the surface of the sintered layered body 10 is not less than the inter-electrode distance T of the varistor electrodes 3–6. FIG. 6 is a graph showing the result of an experiment for determining the relationship between Ty/T and maximum surge current of the varistor 1. In this experiment, varistors having different values of Ty/T were produced, while the distance T was maintained constant and the distance Ty was varied; and respective maximum surge currents of the thus-produced varistors 1 were measured.

As is apparent from the graph, when the value of Ty/T is not less than 1.0, a high maximum surge current can be obtained. However, when the value of Ty/T becomes less than 1.5, the maximum surge current becomes less than 10% the highest maximum surge current of the varistor 1. Conceivably, this drastic decrease conceivably occurs due to, for example, the phenomenon that during the firing process for production of the varistor 1, only the surface portion of the sintered layered body is exposed to a gas atmosphere or the like, so that the characteristics of the surface portion of the sintered layered body 10 differ slightly from those of the inner portion of the sintered layered body 10 where the varistor electrodes 3–6 are disposed.

Figure 7:
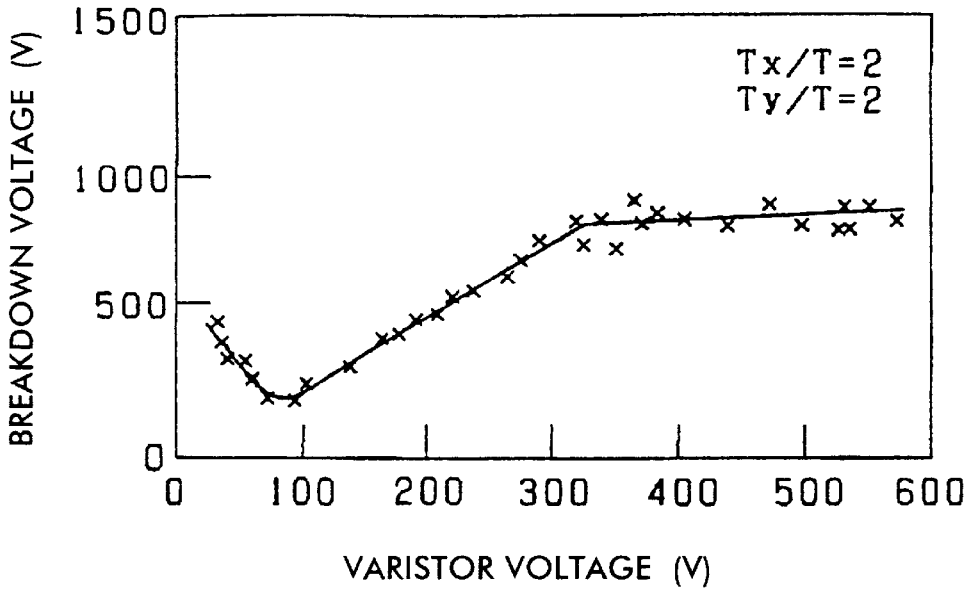
FIG. 7 is a graph showing the relationship between varistor voltage and breakdown voltage.

Further, condition (C) is the case where the above-described conditions (A) and (B) are both satisfied. FIG. 7 shows the results of an experiment in which the relationship between varistor voltage (V1 mA) and breakdown voltage of the monolithic varistor 1 was determined when Tx/T=2 and Ty/T=2.

When the monolithic varistor 1 satisfies any one of these conditions, the varistor 1 can have a high maximum surge current, while maintaining a high varistor voltage. Further, the maximum surge current is maintained substantially constant, so that variation in maximum surge current can be suppressed.

The graphs of FIGS. 5 to 7 show the results of measurement performed in accordance with the following procedure and method. First, a current of 1 mA and a current of 10 mA were successively caused to flow through the varistor 1, and the voltage between the external terminals 11 and 12 of the varistor 1 was measured at these currents. The varistor voltage (V1 mA) was determined on the basis of the thus measured voltages. Next, a surge current was applied to the varistor 1 twice at an interval of 5 minutes, and the varistor 1 was allowed to stand for 1 minute. Subsequently, the varistor voltage (V1mA) was determined in the above-described manner. The surge voltage was gradually increased until the varistor 1 was broken. When the varistor 1 was broken due to surge, the surge current was measured, along with the surge voltage, which was considered the breakdown voltage. Subsequently, the broken varistor 1 was sliced vertically, and the vertical surface was polished. The polished vertical surface was then observed through use of a metal microscope or the like in order to accurately measure the distances Tx, Ty, and T. The graphs shown in FIGS. 5–7 were obtained based on the measurement results.

Figure 8:
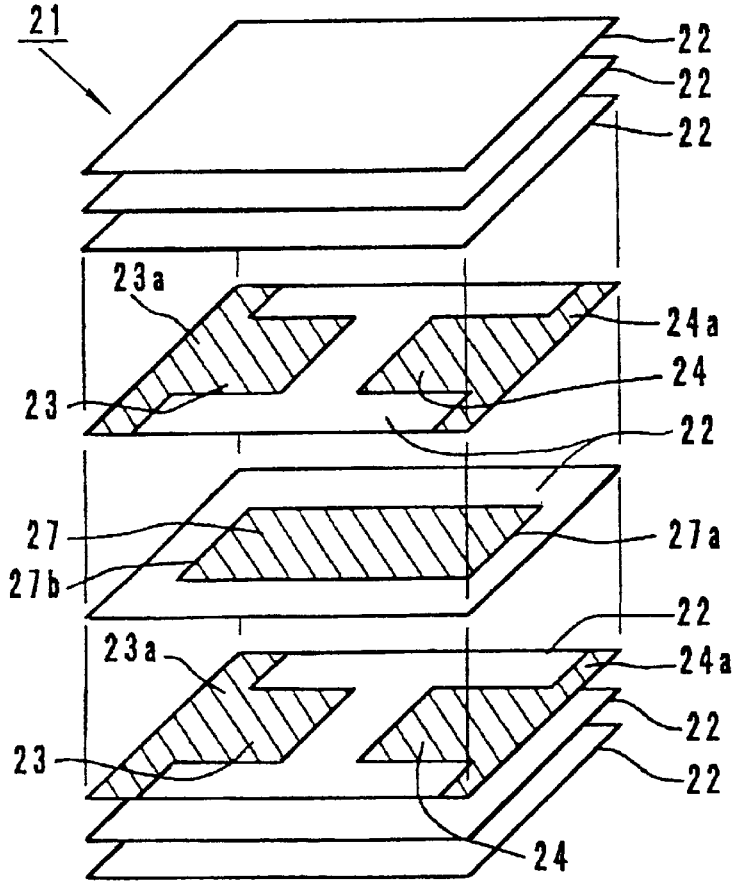
FIG. 8 is an exploded perspective view of a monolithic varistor according to a second embodiment of the present invention.
Figure 9:
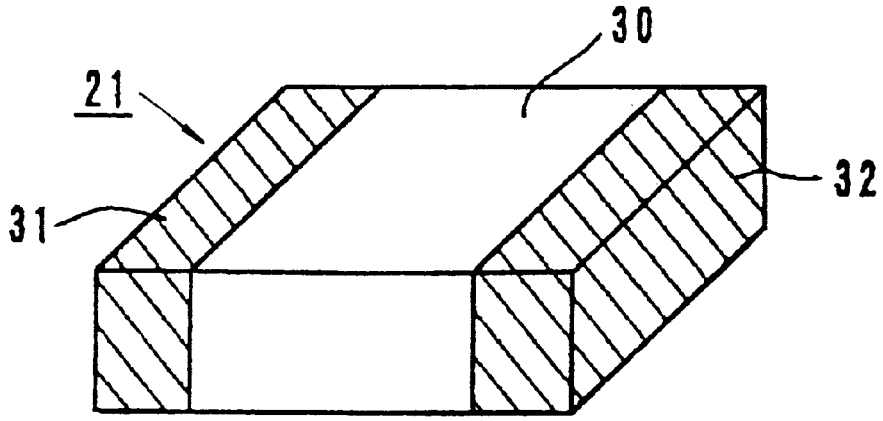
FIG. 9 is a perspective view showing the appearance of the monolithic varistor shown in FIG. 8.
Figure 10:
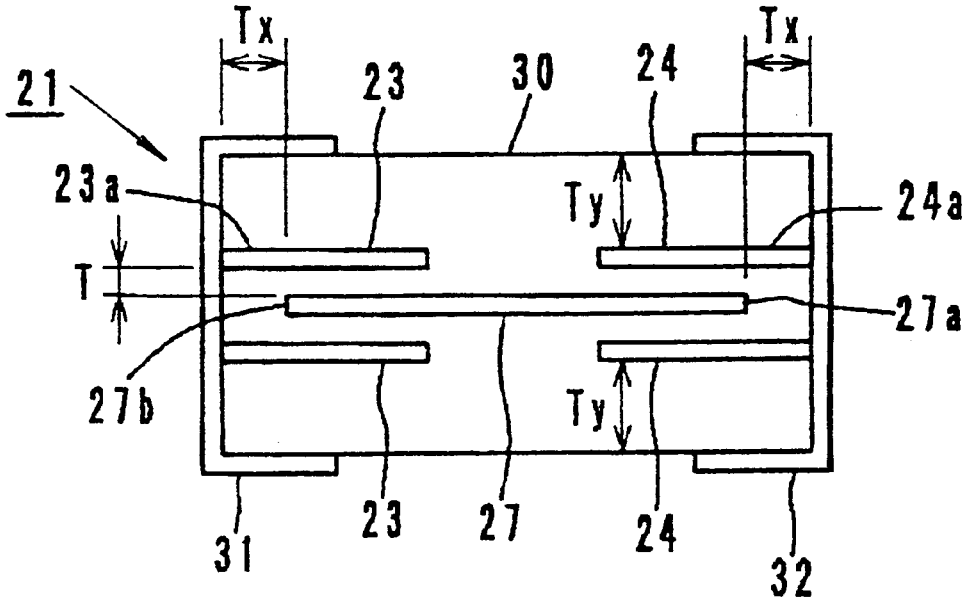
FIG. 10 is a schematic vertical cross section of the monolithic varistor shown in FIG. 9.

Second Embodiment, FIGS. 8–10

As shown in FIG. 8, a monolithic varistor 21 according to the present embodiment comprises varistor sheets 22 on which varistor electrodes 23 and 24 are respectively provided, a varistor sheet 22 on which a float electrode 27 is provided, and protective varistor sheets 22 having no conductors thereon.

The varistor electrodes 23 and 24 are respectively provided in the left and right halves of the surface of the corresponding varistor sheet 22. The lead portion 23*a* of the varistor electrode 23 is exposed at the left side of the varistor sheet 22, and the lead portion 24*a* of the varistor electrode 24 is exposed at the right side of the varistor sheet 22. The float electrode 27 is formed on the surface of the corresponding varistor sheet 22. The varistor electrodes 23 and 24 are opposed to the float electrode 27 with the varistor sheets 22 interposed therebetween.

The respective sheets 22 are layered, and sintered integrally in order to obtain the sintered layered body 30 shown in FIG. 9. External electrodes 31 and 32 are provided on right and left ends of the layered body 30. The lead portions 23*a* of the varistor electrodes 23 are electrically connected to the external electrode 31, and the lead portions 24*a* of the varistor electrodes 24 are electrically connected to the external electrode 32. The float electrode 27 is not connected with either of the external electrodes 31 and 32 and is electrically isolated.

As shown in FIG. 10, in the monolithic varistor 21 having the above-described structure, T is defined as the distance between the varistor electrode 23 or the varistor electrode 24 and the float electrode 27 in the direction perpendicular to the layered varistor sheets 22; and Ty is defined as the distance between the outermost varistor electrode 23 and the upper surface of the sintered layered body 30 or between the outermost varistor electrode 24 and the lower surface of the sintered layered body 30. Further, Tx is defined as the distance, in a direction parallel to the layered varistor sheets 22, between the external electrode 32 provided on the right end of the sintered layered body 30 and the corresponding edge 27*a* of the float electrode 27 or between the external electrode 31 provided on the left end of the sintered layered body 30 and the corresponding edge 27*b* of the float electrode 27. The varistor 21 is designed in order to satisfy one of the following three conditions:

Condition (A) $1.5 \leqq (Tx/T) \leqq 3.0$

Condition (B) $(Ty/T) \geqq 1.0$

Condition (C) $1.5 \leqq (Tx/T) \leqq 3.0$ and $(Ty/T) \geqq 1.0$

When the monolithic varistor 21 satisfies any one of these conditions (A), (B), and (C), the varistor 21 can have a high maximum surge current, while maintaining high varistor voltage. Further, the maximum surge current is maintained substantially constant, so that variation in maximum surge current can be suppressed.

Other Embodiments

The monolithic varistor according to the present invention is not limited to the above-described embodiments, and may be modified in various manners within the scope of the present invention.

The method of producing the monolithic varistor is not limited to the method in which varistor sheets, some of which have varistor electrodes on the surface, are layered and integrally fired; alternatively, pre-fired varistor sheets may be used. Further, the monolithic varistor may be manufactured in the following manner. That is, each varistor-material layer is formed from a varistor material in the form of paste by printing or a like means, and paste of a conductive material is applied on the surface of the varistor-material layer in order to form a varistor electrode or electrodes thereon. Subsequently, paste of the varistor material is applied to cover the varistor electrode in order to form a varistor-material layer containing a varistor electrode. This process is repeated in order to complete a layered structure.

What is claimed is:

1. A monolithic varistor comprising a sintered layered body and a pair of external electrodes disposed on opposite ends of the layered body, the layered body being composed of a plurality of varistor material layers and a plurality of internal electrodes, which are layered on one another in such a manner that the varistor voltage is at least 300 volts, wherein when T is defined as an inter-inner electrode distance in the direction perpendicular to the layered varistor material layers and the internal electrodes and Tx is defined as the distance between the external electrode provided on either end of the layered body and the corresponding edges of the internal electrodes in a direction parallel to the layers, Tx is 1.5 to 3.0 times T, and when Ty is defined as the distance between an outermost inner electrode and the upper surface of the sintered layered body in the direction perpendicular to the layered varistor material layers and the internal electrodes, Ty is equal to or greater than T.

2. A monolithic varistor according to claim 1, wherein at least one of the internal electrodes is a floating electrode disposed between an opposing pair of the internal electrodes and electrically isolated from the external electrodes.

3. A monolithic varistor according to claim 1, wherein the pair of external electrodes disposed on the opposite ends of the layered body extend onto the upper surface of the sintered layered body.

* * * * *